US007972758B2

(12) United States Patent
Hamano

(10) Patent No.: US 7,972,758 B2
(45) **Date of Patent: *Jul. 5, 2011**

(54) TONER FOR DEVELOPMENT OF ELECTROSTATIC IMAGE, METHOD OF PRODUCING THE SAME, ELECTROSTATIC IMAGE DEVELOPER, TONER CARTRIDGE, PROCESS CARTRIDGE, AND IMAGE FORMING APPARATUS

(75) Inventor: Hirokazu Hamano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 639 days.

This patent is subject to a terminal disclaimer.

(21) Appl. No.: 11/808,549

(22) Filed: Jun. 11, 2007

(65) Prior Publication Data

US 2008/0107991 A1 May 8, 2008

(30) Foreign Application Priority Data

Nov. 2, 2006 (JP) ..... 2006-298719

(51) Int. Cl.
*G03G 9/087* (2006.01)

(52) U.S. Cl. ..... 430/109.4; 430/108.8

(58) Field of Classification Search ..... 430/109.4, 430/108.8

See application file for complete search history.

(56) References Cited

U.S. PATENT DOCUMENTS

| | | | | |
|---|---|---|---|---|
| 3,853,778 | A | 12/1974 | Buckley et al. | |
| 4,355,154 | A | 10/1982 | Saam et al. | |
| 7,455,944 | B2 * | 11/2008 | Maehata et al. | 430/109.3 |
| 7,629,098 | B2 * | 12/2009 | Matsumura et al. | 430/109.4 |
| 2002/0106573 | A1 * | 8/2002 | Hamano et al. | 430/111.4 |
| 2003/0091924 | A1 | 5/2003 | Daimon et al. | |
| 2003/0104296 | A1 | 6/2003 | Hamano et al. | |
| 2003/0129518 | A1 * | 7/2003 | Sawada et al. | 430/109.4 |
| 2003/0215731 | A1 | 11/2003 | Saiki et al. | |
| 2004/0191656 | A1 | 9/2004 | Ishiyama et al. | |
| 2005/0042534 | A1 * | 2/2005 | Tanaka et al. | 430/108.4 |
| 2005/0214669 | A1 | 9/2005 | Hayashi et al. | |
| 2006/0057483 | A1 | 3/2006 | Yanase et al. | |
| 2006/0057488 | A1 | 3/2006 | Inoue et al. | |
| 2006/0063086 | A1 * | 3/2006 | Sacripante et al. | 430/109.4 |

(Continued)

FOREIGN PATENT DOCUMENTS

CN 1403879 A 3/2003

(Continued)

OTHER PUBLICATIONS

May 12, 2010 Office Action issued in Chinese Application No. 200710109096.5.

(Continued)

*Primary Examiner* — Hoa V Le
(74) *Attorney, Agent, or Firm* — Oliff & Berridge, PLC

(57) ABSTRACT

The invention provides a toner for development of an electrostatic image, which has colored particles containing a crystalline polyester resin having a melting temperature Tm1 (° C.) of approximately 50 to approximately 100° C., a non-crystalline polyester resin, and a coloring agent, the temperature Tm2 (° C.) of an endothermic peak derived from the crystalline polyester resin in a first process of raising temperature and the temperature Tm3 (° C.) of an endothermic peak derived from the crystalline polyester resin in a second process of raising temperature, in differential scanning calorimetry based on JIS K7121:1987, satisfying the following relationships (1) and (2):

$$0 \leqq (Tm1-Tm2) < 2 \quad (1)$$

$$4 < (Tm1-Tm3) \leqq 15 \quad (2)$$

19 Claims, 2 Drawing Sheets

U.S. PATENT DOCUMENTS

| | | | | |
|---|---|---|---|---|
| 2006/0088779 | A1* | 4/2006 | Sacripante et al. | 430/108.4 |
| 2006/0110674 | A1* | 5/2006 | Maehata et al. | 430/109.3 |
| 2006/0160010 | A1* | 7/2006 | Patel et al. | 430/109.4 |
| 2006/0216623 | A1* | 9/2006 | Matsumura et al. | 430/108.1 |
| 2006/0216625 | A1 | 9/2006 | Maehata et al. | |
| 2006/0292475 | A1* | 12/2006 | Veregin et al. | 430/109.3 |
| 2007/0003856 | A1* | 1/2007 | Farrugia et al. | 430/110.2 |
| 2007/0020551 | A1* | 1/2007 | Sasaki et al. | 430/111.4 |
| 2010/0129748 | A1 | 5/2010 | Inoue et al. | |

FOREIGN PATENT DOCUMENTS

| | | | |
|---|---|---|---|
| CN | 1532636 | A | 9/2004 |
| CN | 1673879 | A | 9/2005 |
| JP | B2-56-013943 | | 4/1981 |
| JP | B2-62-039428 | | 8/1987 |
| JP | B2-63-025335 | | 5/1988 |
| JP | A-63-282752 | | 11/1988 |
| JP | A-06-250439 | | 9/1994 |
| JP | A-10-001536 | | 1/1998 |
| JP | A-2002-351140 | | 12/2002 |
| JP | A-2003-050478 | | 2/2003 |
| JP | A-2004-206081 | | 7/2004 |
| JP | A-2006-84743 | | 3/2006 |
| JP | A-2006-106727 | | 4/2006 |

OTHER PUBLICATIONS

Jun. 4, 2008 Office Action issued in U.S. Appl. No. 11/345,307.

Feb. 17, 2009 Office Action issued in U.S. Appl. No. 11/345,307.

Nov. 16, 2010 Office Action for Japanese Patent Application No. 2006-298719 (with translation).

Mar. 9, 2011 Office Action issued in Chinese Application No. 200710109096.5 (with translation).

* cited by examiner

TONER FOR DEVELOPMENT OF ELECTROSTATIC IMAGE, METHOD OF PRODUCING THE SAME, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2006-298719 filed on Nov. 2, 2006.

BACKGROUND

1. Technical Field

The invention relates to a toner for development of an electrostatic image, a method of producing the same, an electrostatic image developer, a toner cartridge, a process cartridge and an image forming apparatus.

2. Related Art

Generally in electrophotographic methods, a latent image is formed electrically by various means on the surface of a photoreceptor (latent image-holding member) that utilizes a photoconductive substance, and the formed latent image is developed with a toner to form a toner image, and thereafter this toner image is transferred onto the surface of a recording medium such as paper, if necessary via an intermediate transfer member. The transferred image is subjected to a fixing process such as heating, pressurizing, heat-pressurizing, such that an image is formed. Toner that remains on the surface of the photoreceptor is removed by various methods if necessary and utilized again in development of a toner image.

As a fixing technique for fixing a toner image that has been transferred onto the surface of a recording medium, a thermal roll fixing method wherein a recording medium material having a toner image transferred thereon is inserted between a pair of rolls composed of a heating roll and a pressure roll to fix the image is commonly used. As a similar technique, a technique in which one or both of the rolls is substituted with a belt is also known. In these techniques, an image that is fixed fast can be obtained at high speed and energy efficiency is high, because of direct contact with the image, as compared with other fixing methods.

With increased demand for saving the power required for image formation in recent years, techniques of lowering the fixing temperature of a toner in an attempt to save the electric power consumed in the fixing process, which consumes a certain proportion of the energy used in image formation and to expand the temperature range in which the toner can be fixed, are increasingly necessary. By lowering the toner fixing temperature, significant advantages are achieved including not only saving of electric power and expansion of the temperature range in which the toner can be fixed, but also reduction in a waiting time (warm-up time) required to increase the temperature of a member such as a fixing roll from room temperature to a fixable temperature, and achievement of longer operating life.

As a means of lowering the toner fixing temperature, a technique of lowering the glass transition temperature of a binder resin contained in the toner is generally carried out. However, when the glass transition temperature is made too low, powder aggregation (blocking) occurs easily, and thus it is important to satisfy both low-temperature fixability and prevention of blocking.

SUMMARY

According to an aspect of the invention, there is provided a toner for development of an electrostatic image, which has colored particles including a crystalline polyester resin having a melting temperature Tm1 (° C.) of approximately 50 to approximately 100° C., a non-crystalline polyester resin, and a coloring agent, the temperature Tm2 (° C.) of an endothermic peak derived from the crystalline polyester resin in a first process of raising temperature and the temperature Tm3 (° C.) of the endothermic peak derived from the crystalline polyester resin in a second process of raising temperature, in differential scanning calorimetry based on JIS K7121:1987, satisfying the following relationships (1) and (2):

$$0 \leqq (Tm1 - Tm2) < 2 \quad (1)$$

$$4 < (Tm1 - Tm3) \leqq 15 \quad (2)$$

BRIEF DESCRIPTION OF THE DRAWINGS

Exemplary embodiments of the invention will be described in detail based on the following figures, wherein.

DETAILED DESCRIPTION

Figure 1:
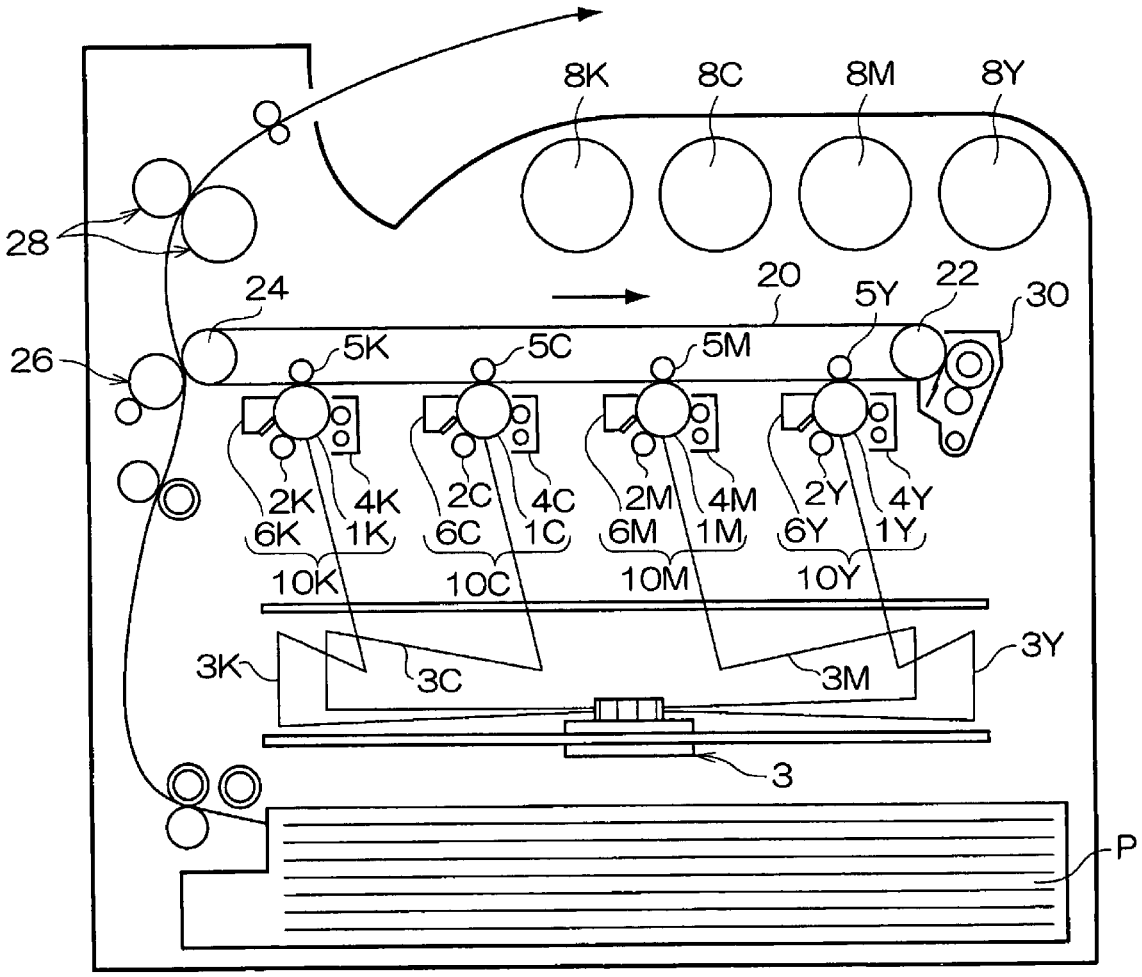
FIG. 1 is a drawing schematically showing one example an image forming apparatus of the invention.

Hereinafter, the invention will be described in detail.

The toner for development of an electrostatic image of the invention (hereinafter referred to sometimes as "toner") has colored particles including a crystalline polyester resin having a melting temperature Tm1 (° C.) of approximately 50 to approximately 100° C., a non-crystalline polyester resin, and a coloring agent, wherein the temperature Tm2 (° C.) of an endothermic peak derived from the crystalline polyester resin in a first process of raising temperature and the temperature Tm3 (° C.) of an endothermic peak derived from the crystalline polyester resin in a second process of raising temperature, in differential scanning calorimetry based on JIS K7121:1987, the disclosure of which is incorporated by reference herein, satisfy the following relationships (1) and (2):

$$0 \leqq (Tm1 - Tm2) < 2 \quad (1)$$

$$4 < (Tm1 - Tm3) \leqq 15 \quad (2)$$

The toner contains both a crystalline polyester resin and a non-crystalline polyester resin as binder resins, and in this kind of toner, the compatibilization between the crystalline polyester resin and non-crystalline polyester resin proceeds, thereby causing plasticization of the mixed resin and thus failing to achieve sufficient storage stability (thermal storage stability) in some cases. The crystalline polyester resin having a low melting temperature may have low electric resistance, and with the progress of compatibilization of the crystalline polyester resin, low-resistance conductive paths are formed inside the toner, and as a result, charging amount and charging retaining property may lower, and dependence of charging amount on external environment may deteriorate.

In the invention, it is found that, in order to satisfy both low-temperature fixability and storage stability, the toner should satisfy the relationships (1) and (2). In the relationships, Tm1, Tm2 and Tm3 are determined by differential scanning calorimetry (DSC), wherein Tm1 is the melting temperature of the crystalline polyester resin used in the toner, Tm2 is the temperature of an endothermic peak derived from the crystalline polyester resin in a first process of raising temperature and Tm3 is the temperature of an endothermic peak derived from the crystalline polyester resin in a second process of raising temperature in DSC of the toner.

Specifically, when the relationship (1) stands, it is indicated that the drop in the melting temperature of the crystalline polyester resin is low in binder resins containing both the resins, and it is meant that inside the toner, the crystalline polyester resin is dispersed in a state where the crystalline polyester resin is not compatible with the non-crystalline polyester resin. By dispersing the crystalline polyester resin in a non-compatible state inside the toner, the non-crystalline polyester resin is not plasticized, and as a result, the thermal storage stability of the toner can be maintained. By dispersing the crystalline polyester resin in the non-crystalline polyester resin, conductive paths of the crystalline polyester resin are not formed inside the toner, and as a result, the charging property of the toner can be kept good.

When the relationship (2) stands, it is indicated that the drop in the melting temperature of the crystalline polyester resin is significant, and it is meant that after the toner is melted at a temperature not lower than the melting temperature of the crystalline polyester resin, the liquid crystalline polyester resin and the non-crystalline polyester resin are in a state where both the resins are compatible with each other. That is, the crystalline polyester resin after being melted is compatible with the non-crystalline polyester resin, which can thus lower the viscosity of the non-crystalline polyester resin. As a result, excellent low-temperature fixability can be obtained.

Low-temperature fixation means fixation by heating at a temperature of 120° C. or less.

When (Tm1−Tm2) in the relationship (1) is 2° C. or more, the toner that has not been subjected to heating history after production cannot secure sufficient storage stability. (Tm1−Tm2) is preferably 1° C. or less, and most preferably ° C. (that is, Tm1 and T2*m* accord with each other).

When (Tm1−Tm3) in the relationship (2) is 4° C. or less, compatibility between the crystalline polyester resin and the non-crystalline polyester resin is low, and low-temperature fixation is not sufficient. When (Tm1−Tm3) is greater than 15° C., storage stability of an image after fixation is problematic in some cases.

(Tm1−Tm3) preferably satisfies the following relationship (2') and more preferably satisfies the following relationship (2"):

$$4.5 \leqq (Tm1 - Tm3) \leqq 13 \quad (2')$$

$$4 \leqq (Tm1 - Tm3) \leqq 12 \quad (2'')$$

The melting temperature Tm1 of the crystalline polyester resin or the temperatures Tm2 and Tm3 of endothermic peaks derived from the crystalline polyester resin are determined as melting-peak temperatures in input compensation differential scanning calorimetry shown in JIS K-7121:1987, by using a differential scanning calorimeter (DSC).

Measurement conditions are as follows:

Measurement of Tm1

Tm1 is determined from the peak temperature of the maximum endothermic peak obtained by measuring endothermic property of a measurement sample, namely the crystalline polyester resin alone (which was used in the toner) in a temperature range of from 0 to 150° C. at a programming rate of 10° C./min.

Measurement of Tm2

Tm2 is determined from the peak temperature of the maximum endothermic peak obtained by measuring endothermic property of the toner as a measurement sample in a temperature range of from 0 to 150° C. at a programming rate of 10° C./min (first process of raising temperature).

Measurement of Tm3

Tm3 is determined from the peak temperature of the maximum endothermic peak obtained after conducting the first process of raising temperature, keeping the toner at 150° C. for 5 minutes, decreasing the temperature of the sample to 0° C. at a temperature falling rate of −10° C./min, keeping the sample at 0° C. for 10 minutes, and heating the sample to 150° C. at a programming rate of 10° C./min (second process of raising temperature).

In these measurements, nitrogen is introduced at 20 ml/min., and alumina is used as a standard sample for the measurement sample. Because some crystalline polyester resins show plural melting peaks, the maximum peak temperature is regarded as the melting temperature in the invention.

In measurement of Tm1, the crystalline polyester resin is used alone as a measurement sample as described above, and this crystalline polyester resin may be a resin extracted directly from the toner.

In extraction of the crystalline polyester from the toner, a solvent such as ethyl acetate or toluene in which the crystalline resin is not dissolved but the non-crystalline resin is dissolved can be selected and the mixed system of the toner and the solvent is filtered to collect insolubles to extract the crystalline polyester.

Hereinafter, the configuration of the toner for development of an electrostatic image according to the invention will be described in more detail. The following is the first embodiment of the invention and not intended to limit the scope of the invention.

Crystalline Polyester Resin

A crystalline polyester resin having a melting temperature Tm1 of approximately 50 to approximately 100° C. may be dispersed in colored particles in the toner of this exemplary embodiment. The crystalline polyester resin can be so easily selected as to have a suitable melting temperature, is excellent in compatibility with the non-crystalline polyester resin, is thus effective for rendering the toner fixable at low temperatures and does not lower adhesive property of the toner to paper after fixation.

In the invention, the "crystalline polyester resin" refers to a resin showing not stepwise change in endothermic quantity but a clear endothermic peak in differential scanning calorimetry (DSC). The crystalline polyester resin includes a polymer having another component copolymerized with the main chain thereof in which polymer the content of another component is 50 mol % or less.

An aromatic crystalline polyester resin generally has a melting temperature higher than the melting-temperature range mentioned above, and therefore the crystalline polyester resin in this exemplary embodiment is preferably an aliphatic crystalline polyester resin.

The melting temperature Tm1 of the crystalline polyester resin used in this exemplary embodiment is in the range of about 50 to about 100° C. from the viewpoint of the balance between low-temperature fixability and storage stability. Tm1 is preferably in the range of about 55 to about 95° C., and more preferably in the range of about 60 to about 90° C. When the melting temperature is lower than about 50° C., the storage stability of the toner and the storage stability of a toner image after fixation may be low. When the melting temperature is higher than about 100° C., sufficient low-temperature fixation cannot be obtained as compared with conventional toners.

The crystalline polyester resin is synthesized from an acid (dicarboxylic acid) component and an alcohol (diol) component. In the following description, an "acid-derived constituent component" refers to a constituent site which is an acid component before synthesis of polyester resin, and an "alcohol-derived constituent component" refers to a constituent site which is an alcohol component before the synthesis of polyester resin.

-Acid-derived Constituent Component-

The acid for use as the acid-derived constituent component includes various dicarboxylic acids, and the acid-derived constituent component in the crystalline polyester resin in the invention is preferably an aromatic dicarboxylic acid and/or an aliphatic dicarboxylic acid. Among them, an aliphatic dicarboxylic acid is preferable, and a linear dicarboxylic acid is more preferable.

Examples of the aliphatic dicarboxylic acid include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters thereof and acid anhydrides thereof. Among these compounds, adipic acid, sebacic acid and/or 1,10-decanedicarboxylic acid is preferable in consideration of easy availability.

The acid-derived constituent component may contain constituent components such as a constituent component derived from a dicarboxylic acid having a double bond and a constituent component derived from a dicarboxylic acid having a sulfonic acid group, besides the above-mentioned aromatic dicarboxylic acid and/or aliphatic dicarboxylic acid.

The constituent component derived from a dicarboxylic acid having a double bond includes not only constituent components derived from dicarboxylic acids having at least one double bond but also constituent components derived from lower alkyl esters or acid anhydrides of dicarboxylic acids having at least one double bond. The constituent component derived from a dicarboxylic acid having a sulfonic acid group includes not only constituent components derived from dicarboxylic acids having at least one sulfonic acid group but also constituent components derived from lower alkyl esters or acid anhydrides of dicarboxylic acids having at least one sulfonic acid group.

The content, in the whole of the acid-derived constituent components, of the acid-derived constituent components (that is, the constituent component(s) derived from a dicarboxylic acid or acids having at least one double bond and the constituent component(s) derived from a dicarboxylic acid or acids having at least one sulfonic acid group) other than the aliphatic dicarboxylic acid-derived constituent component(s) and the aromatic dicarboxylic acid-derived constituent component(s) is preferably in the range of about 1 to about 20 constituent-mol %, and more preferably in the range of about 2 to about 10 constituent-mol %.

In the specification, the "constituent-mol %" refers to percentage given that each of the above-mentioned acid-derived constituent component (constituent component derived from a dicarboxylic acid having at least one double bond and constituent component derived from a dicarboxylic acid having at least one sulfonic acid group) sites in the whole of acid-derived constituent component sites or below-mentioned alcohol-constituent component (aliphatic diol-derived constituent component) sites in the whole of alcohol-derived constituent component sites in the polyester resin is 1 unit (mol).

-Alcohol-derived Constituent Component-

The alcohol for use as the alcohol-derived constituent component is preferably an aliphatic diol, and more preferably a linear aliphatic diol having 7 to 20 carbon atoms.

Examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. In consideration of easy availability and costs, 1,4-butanediol, 1,6-hexanediol, 1,8-octanediol, 1,9-nonanediol and/or 1,10-decanediol is preferable.

The alcohol-derived constituent component contains preferably at least 80 constituent-mol % aliphatic diol-derived constituent component and if necessary other components. The alcohol-derived constituent component contains more preferably at least 90 constituent-mol % of the aliphatic diol-derived constituent component.

There is no particular limit to a method of producing the crystalline polyester resin, and the resin can be produced by a general method of polymerizing a polyester in which general method an acid component is reacted with an alcohol component, such as a direct polycondensation method or an ester exchange method, and a suitable method is selected depending on the types of monomers. The molar ratio of the acid component to the alcohol component (acid component/alcohol component) to be reacted with each other varies depending on, for example, reaction conditions, and cannot be generalized, but is usually about 1/1 for a higher molecular weight of the product.

Production of the crystalline polyester resin can be carried out at a polymerization temperature of about 180 to about 230° C., and the reaction is carried out in the reaction system that may be under a reduced pressure while water and alcohol generated upon condensation are removed.

When the monomers are not dissolved or compatible with each other at the reaction temperature, a high-boiling solvent may be added to the reaction system as a solubilizer to dissolve the monomers. Polycondensation reaction is carried out while the solubilizer solvent is distilled away. When there is a monomer having poor compatibility in copolymerization reaction, the monomer having poor compatibility may be previously condensed with an intended carboxylic acid component or alcohol component and the resultant may be then copolymerized with a major component.

A catalyst usable in production of the crystalline polyester resin includes alkali metal compounds such as those of sodium and lithium; alkaline earth metal compounds such as those of magnesium and calcium; metal compounds such as those of zinc, manganese, antimony, titanium, tin, zirconium, and germanium; and phosphorous acid compounds, phosphoric acid compounds and amine compounds.

Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenyl phosphonium bromide, triethylamine, and triphenylamine.

The weight-average molecular weight (Mw) of the crystalline polyester resin is preferably in the range of about 2,000 to about 12,000, and more preferably in the range of about 2,500 to about 10,000 from the viewpoints of resin productivity, dispersion of the toner during production, and giving of compatibility on the toner upon melting.

The weight-average molecular weight can be measured by gel permeation chromatography (GPC). Measurement of the molecular weight by GPC is carried out by using THF solvent, a measuring instrument GPC-HLC-8120 manufactured by Tosoh Corporation and a column TSK GEL SUPER HM-M (15 cm) manufactured by Tosoh Corporation. From this measurement result, the weight-average molecular weight is calculated by using a molecular weight calibration curve prepared using a monodisperse polystyrene standard sample.

The acid value of the crystalline polyester resin is preferably in the range of about 2 to about 30 mg KOH/g, and more preferably about 3 to about 25 mg KOH/g.

In this exemplary embodiment, the content of the crystalline polyester resin in the toner is preferably in the range of about 3 to about 40 wt %, and more preferably in the range of about 5 to about 35 wt %. When the content of the crystalline polyester resin is less than about 3 wt %, the viscosity of the non-crystalline polyester resin cannot be reduced to a sufficiently level upon melting, which may result in failure to attain sufficient low-temperature fixability. When the content is greater than about 40 wt %, the crystalline polyester resin is difficult to uniformly disperse, which may result in deterioration in charging property. After fixation, sufficient image strength may not be obtained in some cases.

Non-crystalline Polyester Resin

The "non-crystalline polyester resin" used in the invention refers to a resin showing not a clear endothermic peak but stepwise change in endothermic quantity in differential scanning calorimetry (DSC) and is obtained mainly by copolymerizing at least one polyvalent carboxylic acid component with at least one polyhydric alcohol component.

Examples of the polyvalent carboxylic acid include aromatic carboxylic acids such as terephthalic acid, isophthalic acid, phthalic acid anhydride, trimellitic acid anhydride, pyromellitic acid and naphthalenedicarboxylic acid, aliphatic carboxylic acids such as maleic acid anhydride, fumaric acid, succinic acid, alkenylsuccinic acid anhydride and adipic acid, and alicyclic carboxylic acids such as cyclohexanedicarboxylic acid. One polyvalent carboxylic acid, or two or more polyvalent carboxylic acids may be used. It is preferable to use an aromatic carboxylic acid among these polyvalent carboxylic acids. It is preferable to use a trivalent or higher-valent carboxylic acid (e.g., trimellitic acid or anhydride thereof) together with dicarboxylic acid, so as to form a crosslinking structure or a branched structure to secure good fixability.

Examples of the polyhydric alcohol include aliphatic diols such as ethylene glycol, diethylene glycol, triethylene glycol, propylene glycol, butanediol, hexanediol, neopentyl glycol and glycerin, alicyclic diols such as cyclohexanediol, cyclohexane dimethanol and hydrogenated bisphenol A, and aromatic diols such as ethylene oxide adduct of bisphenol A and propylene oxide adduct of bisphenol A. One of these polyhydric alcohols may be used alone or two or more of them may be used together. Among these polyhydric alcohols, aromatic diol and/or alicyclic diol is preferable and aromatic diol is more preferable. A trivalent or higher valent polyhydric alcohol (e.g., glycerin, trimethylolpropane and pentaerythritol) may be used together with a diol, so as to form a crosslinking structure or a branched structure to secure good fixability.

There is no particular limit to a method of producing the non-crystalline polyester resin, and a method on the basis of the aforementioned method of producing the crystalline polyester resin can be used.

The weight-average molecular weight of the non-crystalline polyester resin in the invention is preferably in the range of about 5,000 to about 50,000, and more preferably in the range of about 8,000 to about 40,000. The weight-average molecular weight can be measured by gel permeation chromatography (GPC) on the basis of polystyrene conversion.

The glass transition temperature (Tg) of the non-crystalline polyester resin is preferably in the range of about 40 to about 80° C., more preferably in the range of about 45 to about 75° C., and still more preferably in the range of about 50 to about 70° C. When the Tg is higher than about 80° C., the toner may be less fixed at a low temperature than conventional toners. When the Tg is lower than about 40° C., sufficient thermal storage stability cannot be obtained, and the storage stability of a fixed image may not be sufficient.

The non-crystalline polyester preferably satisfies the following relationships (3) and (4):

$$SPA<SPB \tag{3}$$

$$(SPB-SPA)<1.2 \tag{4}$$

Here, SPA is the solubility parameter of the crystalline polyester resin, and SPB is the solubility parameter of the non-crystalline polyester resin.

When SPA is greater than SPB as opposed to the relationship (3), the crystalline polyester resin easily precipitates on the surfaces of toner particles in preparation of the toner, resulting in failure to attain sufficient toner flowability in some cases. When the difference between SPB and SPA is 1.2 or more as opposed to the relationship (4), the compatibility between the crystalline polyester resin and the non-crystalline polyester resin lowers, resulting in failure to attain sufficient low-temperature fixability in some cases.

The solubility parameter (hereinafter referred to sometimes as "SP value") can be calculated from the configuration of polymerizable monomers by using the following equation (5) according to the method of Fedors et al. (Polym. Eng. Sci. vol. 14, p. 147 (1974)) using the additive property of atomic group:

$$\text{SP value}=(\Sigma\Delta ei/\Sigma\Delta vi)^{1/2} \tag{5}$$

Here, Δei is the evaporation energy of an atom or an atomic group, and Δvi is the molar volume of the atom or atomic group.

From the foregoing viewpoints, a polyester resin obtained for example by polymerizing sebacic acid with decanediol is preferably used as the crystalline polyester resin, and a polyester resin obtained for example by polymerizing alkenylsuccinic acid as an acid component with an alkylene glycol adduct of bisphenol as an alcohol component is preferably used as the non-crystalline polyester resin.

Coloring Agent

The coloring agent(s) used in the toner of the invention may be a dye and/or a pigment, and is preferably a pigment from the viewpoints of light resistance and water resistance.

Typical examples of the coloring agent that can be used include known pigments such as carbon black, aniline black, aniline blue, charcoyl blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The content of the coloring agent(s) in the toner for development of an electrostatic image in this exemplary embodiment is preferably in the range of about 1 to about 30 parts by weight based on 100 parts by weight of the binder resin(s). It is also effective to use a coloring agent whose surface is treated as necessary, or a pigment dispersant. By selecting the type of the coloring agent, a yellow toner, magenta toner, cyan toner, black toner or the like can be obtained.

Other Additives

As described above, the components of the toner in this exemplary embodiment are not particularly limited insofar as they contain at least a crystalline polyester resin and non-crystalline polyester resin as binder resins. If necessary, the toner may contain other components such as a releasing agent.

Specific examples of the releasing agent include low molecular weight polyolefins such as polyethylene, polypropylene, and polybutene; silicones having a softening temperature upon heating; fatty acid amides such as amide oleate, amide erucate, amide ricinoleate, and amide stearate; vegetable wax such as camauba wax, rice wax, candelilla wax, Japan wax, and jojoba oil; animal wax such as beeswax; mineral and petroleum wax such as montan wax, ozokerite, ceresin, paraffin wax, microcrystalline wax, and Fischer-Tropush wax; and ester wax such as fatty acid ester, ester montanate, and ester carboxylate.

In the invention, one of these releasing agents may be used alone or two or more of them can be used together. Preferably, a mixture of two or more thereof is used.

The content of the releasing agent(s) in this exemplary embodiment is preferably in the range of about 0.5 to about 50 wt %, and more preferably in the range of about 1 to about 30 wt %, relative to the total amount of the toner.

The toner in this exemplary embodiment may further include various components such as an internal additive, a charge control agent, inorganic particulate matter (inorganic particles), and organic particles as necessary.

Examples of the internal additive include magnetic substances, for example metals and alloys such as ferrite, magnetite, reduced iron, cobalt, nickel, and manganese, and compounds including such metals.

Examples of the charge control agent include dyes such as a quaternary ammonium salt compound, a nigrosine compound, and a complex including aluminum, iron or chromium, and a tripheylmethane pigment.

The inorganic particles are included for various purposes and may be included for regulation of the viscoelasticity of the toner. By regulating the viscoelasticity, image glossiness and penetration of the toner into paper can be regulated. As the inorganic particles, known inorganic particles, such as silica particles, titanium oxide particles, alumina particles, and cerium oxide particles, and those whose surface is made hydrophobic may be used. One type of these inorganic particles may be used or two or more types of them can be used together. Among them, silica particles having a lower refractive index than that of the binder resin are preferably used from the viewpoints of preventing deterioration in coloring properties and transparency such as OHP transmission. The silica particles may be subjected to various kinds of surface treatments. For example, silica particles whose surface is treated with a silane coupling agent, a titanium coupling agent, or silicone oil are preferably used.

The inorganic particles may be added externally to colored particles for the purpose of improving flowability of the toner. Examples of the inorganic particles include particles of silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, silica particles are preferable, and hydrophobicized silica particles are particularly preferable.

Toner Characteristics

The volume-average particle diameter of the toner in the invention is preferably in the range of about 3.0 to about 9.0 μm, and more preferably in the range of about 4.0 to about 8.0 μm. When the volume-average particle diameter is less than about 3.0 μm, the toner fluidity lowers, the charging properties of each particle easily deteriorates, and charging distribution broadens, and thus fogging on the background or dropping of the toner from a developing device occurs easily. When the volume-average particle diameter of the toner is greater than about 9.0 μm, definition may lower, thus failing to attain sufficient image quality.

The volume-average particle diameter can be measured by COULTER MULTISIZER II (manufactured by Beckmann-Coulter) with an aperture diameter of 50 μm. In this case, the toner is dispersed in an electrolyte aqueous solution (ISOTON aqueous solution) and stirred for 30 seconds or more by ultrasonic wave prior to measurement.

As described previously, the toner in this exemplary embodiment is preferably such that the crystalline polyester resin is dispersed in colored particles. The term "dispersed" means that the crystalline polyester resin does not form a continuous and large phase in colored particles, but is present in a granular form or in a form analogous thereto wherein its particles exist discretely.

In this exemplary embodiment, the average diameter of the crystalline polyester resin dispersed in the colored particles (average dispersion particle diameter) is preferably in the range of about 0.05 to about 1.0 μm, and more preferably in the range of about 0.08 to about 0.9 μm.

When the average diameter of the dispersed resin particles is less than about 0.05 μm, production of such a toner may be difficult in some cases. When the average diameter of the dispersed resin particles is greater than about 1.0 μm, the contact area between the crystalline polyester resin and the non-crystalline polyester resin decreases, so the compatibility therebetween lowers, thus failing to attain good low-temperature fixability in some cases.

The average dispersion particle diameter of the crystalline polyester resin is determined by observing a section of a transmission electron microscopic (TEM) image that is obtained by magnifying each of 3000 particles of the resulting toner 5000 times, obtaining the particle diameter of the crystalline polyester resin in each toner particle by an image analyzer, and averaging the resulting diameters. This will be described later in more detail.

A method of producing the toner in this exemplary embodiment includes a dry process and a wet process. A kneading milling method that is one dry process is not preferable because the crystalline polyester resin and the non-crystalline polyester resin are melt and kneaded and thus the crystalline polyester resin is difficult to disperse in a non-compatible state in the non-crystalline polyester resin. The wet process includes an emulsion aggregation method, and a dissolution suspension method. Among them, a dissolution suspension method is preferable in that the crystalline polyester resin can be easily dispersed in a non-compatible state in the non-crystalline polyester resin.

<Method of Producing Toner for Development of Electrostatic Image>

A method of producing the toner for development of an electrostatic image of the invention includes respectively dissolving or dispersing at least a coloring agent, a non-crystalline polyester resin and a crystalline polyester resin in a solvent to prepare a liquid mixture of a toner composition, dispersing and suspending the liquid mixture of the toner composition in an aqueous solvent to prepare a dispersed suspension of the toner composition, and removing the solvent from the dispersed suspension of the toner composition.

As described previously, the crystalline polyester resin is preferably dispersed in colored particles in the toner of the invention. However, it is difficult to mix two resins not compatible with each other, such that one resin exists as dispersed particles having a diameter smaller than a predetermined particle size.

In the invention, the following has been found. The dispersion of the crystalline polyester resin by an emulsion aggregation method used to employ the crystalline resin in the toner is not sufficient. Thus, a solvent having unique properties in dissolving each of the crystalline polyester resin and the non-crystalline polyester resin is selected and used to prepare a liquid mixture of the toner composition, and the liquid mixture is dispersed and suspended in an aqueous medium, whereby a preferable structure of the toner of the invention can be formed.

Hereinafter, the method of producing the toner for development of an electrostatic image of the invention is described by reference to a process using a dissolution suspension method. The dissolution suspension method includes the configuration of the invention; that is, this method includes dissolving or dispersing at least binder resins (that is, resins containing at least one crystalline polyester resin and at least one non-crystalline polyester resin in the invention) and at least one coloring agent respectively in a solvent to prepare a liquid mixture of a toner composition, dispersing and suspending the liquid mixture of a toner composition in an aqueous solvent to prepare a dispersed suspension of the toner composition, and removing the solvent from the dispersed suspension of the toner composition. Hereinafter, each step will be described sequentially.

Preparing Liquid Mixture

In preparing a liquid mixture, at least binder resins and at least one coloring agent are dissolved or dispersed respectively in a solvent to give a liquid mixture of a toner composition. In the mixing, resins containing the crystalline polyester resin and the non-crystalline polyester resin are used as the binder resins, and besides the binder resins and the coloring agent(s), additives such as at least one dispersant for the coloring agent(s), at least one releasing agent and at least one charge control agent usually contained in colored particles may be contained in the toner composition, if necessary. A surfactant may also be contained, but is contained preferably in a small amount. This is because some surfactants are difficult to remove.

Examples of the solvent include ester solvents such as methyl acetate, ethyl acetate, propyl acetate and butyl acetate; ether solvents such as diethyl ether, dibutyl ether and dihexyl ether; ketone solvents such as methyl ethyl ketone, methyl isopropyl ketone, methyl isobutyl ketone and cyclohexanone; hydrocarbon solvents such as toluene, xylene and hexane; and halogenated hydrocarbon solvents such as dichloromethane, chloroform and trichloroethylene.

Among these solvents, a solvent in which the crystalline polyester resin is not dissolved but the non-crystalline polyester resin is dissolved is preferably selected. By selecting such a solvent, the crystalline resin can be dispersed in a non-compatible state inside colored particles mainly composed of the non-crystalline polyester resin. The phrase "the crystalline polyester resin is not dissolved" includes not only the state in which the resin is not completely dissolved but also the state in which the resin is dissolved slightly but not completely (in this case, the solution is cloudy).

The solvent is preferably a solvent whose portion dissolved in water is about 0 to 30 wt %. For industrial application, cyclohexane or ethyl acetate is preferably used as the solvent in consideration of safety in operation, cost and productivity.

From the above viewpoints, ethyl acetate is preferably used as the solvent, for example when an aliphatic crystalline resin is used as the crystalline polyester resin and a polyester resin obtained by polycondensation of a diol mainly including bisphenol-type diol and a dicarboxylic acid mainly including terephthalic acid is used as the non-crystalline polyester resin.

In preparing the liquid mixture, the binder resins previously kneaded with the coloring agent(s) and, if necessary, with other additives may be dissolved or dispersed in the preferable solvent described above, or the binder resins may be dissolved or dispersed in the solvent followed by dissolving or dispersing the coloring agent and, if necessary, other additives in the system.

First, the liquid mixture of a toner composition may be formed by dispersing at least one crystalline polyester resin in at least one solvent so as to have a particle diameter in a predetermined range and then adding at least one non-crystalline polyester resin and at least one coloring agent thereto, followed by dissolving the non-crystalline polyester resin in the system.

In this case, the average dispersion particle diameter of the crystalline polyester resin is preferably in the range of about 0.05 to about 1.0 μm. The average dispersion particle diameter can be measured by using a laser diffraction-type particle size distribution measuring device.

The dissolution or dispersion can be carried out with a media-containing dispersing machine such as a ball mill or a sand mill or with a high-pressure dispersing machine. However, preparing the liquid mixture can be carried out by any methods as far as the binder resin is dissolved in the solvent (the crystalline polyester resin may be partially or wholly dispersed) to give a liquid mixture of a toner composition having the coloring agent dispersed therein.

In this exemplary embodiment, the solid content of the liquid mixture of the toner composition is preferably in the range of about 10 to about 50 wt %.

The viscosity of the liquid mixture of the toner composition at 20° C. is preferably in the range of about 1 to about 10,000 mpa·s, and more preferably in the range of about 1 to about 2,000 mPa·s.

Preparing Dispersed Suspension

In preparing the dispersed suspension, the liquid mixture of a toner composition (hereinafter referred to sometimes as "liquid mixture") obtained in preparing the liquid mixture is added to an aqueous medium and dispersed and suspended to give a dispersed suspension of the toner composition (hereinafter referred to sometimes as "dispersed suspension"). In preparing the dispersed suspension, the temperature of the dispersed suspension is preferably about 0° C. to about 35° C. When the temperature of the dispersed suspension is higher than about 35° C., the coloring agent(s) may aggregate in the dispersed particles or may localize in the outer peripheries of the dispersed particles, and the dispersion state of the coloring agent(s) may be uneven. When the temperature is less than about 0° C., the particle size distribution of the dispersed particles may broaden.

The temperature of the dispersed suspension in this step is controlled by regulating the temperature of each of the liquid mixture and the aqueous medium used, and both the temperature of the liquid mixture of the toner composition and the temperature of the aqueous medium are preferably about 0° C. to about 35° C.

A change in the temperature of the dispersed suspension from the start of the dispersion and suspension to the end of the dispersion and suspension is preferably within 10° C., more preferably within 5° C., and still more preferably within 3° C. When this temperature change exceeds 10° C., the particle size distribution is not in a steady state and reproduction is not obtained in some cases. The change in the temperature of the dispersed suspension from the start of the dispersion and suspension to the end of the dispersion and suspension means a difference between the maximum temperature and the lowest temperature of the dispersed suspension from the start of the dispersion and suspension to the end of the dispersion and suspension.

When an emulsifying machine or a dispersing machine is used in dispersion and suspension, the temperature of the dispersed suspension from the start of the dispersion and suspension to the end of the dispersion and suspension increases, and is thus preferably regulated by forced cooling by a cooling medium.

The aqueous medium is preferably a medium having an inorganic dispersant dispersed in water. To narrow the particle-size distribution of the colored particles, it is preferable that the inorganic dispersant is dispersed in water, while a polymer dispersant dissolved in water is also added. Water used in this embodiment is preferably deionized water, distilled water or purified water.

The inorganic dispersant is preferably a hydrophilic inorganic dispersant, and specific examples thereof include silica, alumina, titania, calcium carbonate, magnesium carbonate, tricalcium phosphate, clay, diatomaceous earth, and bentonite. Among these, calcium carbonate is particularly preferable.

The inorganic dispersant is more preferably coated thereon with a polymer having at least one carboxyl group, from the viewpoint of enabling production of stable colored particles. The polymer having at least one carboxyl group preferably has a number-average molecular weight in the range of about 1,000 to about 200,000, and typical examples thereof include acrylic acid resin, methacrylic acid resin, fumaric acid resin and maleic acid resin. Specifically, homopolymers or copolymers of constituent monomers in the above resins, that is, acrylic acid, methacrylic acid, fumaric acid and maleic acid, or copolymers of such constituent monomers and other vinyl monomers, can also be used. The carboxyl group may be preferably a salt of metal such as sodium, potassium or magnesium.

The average particle diameter of the inorganic dispersant is preferably about 1 to about 1,000 nm, and more preferably about 5 to about 500 nm.

The amount of the inorganic dispersant used is preferably in the range of about 1 to about 500 parts by weight, and more preferably in the range of about 10 to about 200 parts by weight, based on 100 parts by weight of the toner composition. The inorganic dispersant is dispersed in water preferably with a media-containing dispersing machine such as a ball mill or with a high-pressure dispersing machine or an ultrasonic dispersing machine.

The polymer dispersant is preferably hydrophilic. The polymer dispersant particularly preferably have at least one carboxyl group but does not have a lipophilic group such as a hydroxypropyl group or methoxyl group. Specific examples of the polymer dispersant include water-soluble cellulose ethers such as carboxymethyl cellulose and carboxyethyl cellulose, among which carboxymethyl cellulose is particularly preferable. These cellulose derivatives are preferably those having an etherification degree of about 0.6 to about 1.5 and an average polymerization degree of about 50 to about 3,000. The carboxyl group may be a salt of metal such as sodium, potassium or magnesium.

The optimum amount of the polymer dispersant used is determined according to the viscosity of the liquid mixture of the toner composition. When the amount of the polymer dispersant used is greater or lower than the optimum amount, the particle-size distribution of the colored particles formed may not be sharp. Specifically, the polymer dispersant is contained preferably in such an amount that the viscosity of the aqueous medium at 20° C. is in the range of approximately 1 to approximately 3,000 mPa·s, and more preferably in the range of approximately 1 to approximately 1,000 mPa·s. The polymer dispersant may be added to the system by any methods as far as it can be dissolved uniformly in water.

The liquid mixture of the toner composition is added preferably in the range of about 5 to about 150 parts by weight to 100 parts by weight of the aqueous medium containing the inorganic dispersant(s) and polymer dispersant(s) described above.

The dispersion and suspension is carried out by using a generally commercially available emulsifying or dispersing machine, and an emulsifying or dispersing machine having a rotary blade is preferably used. Examples of such an emulsifying or dispersing machine include batch emulsifying machines such as ULTRATURRAX (manufactured by IKA) and TK Auto Homomixer (manufactured by Tokushu Kika Kogyo Co., Ltd.), continuous emulsifying machines such as EBARA MILDER (manufactured by Ebara Corporation), a TK pipeline homomixer, TK homomic line flow (manufactured by Tokushu Kika Kogyo Co., Ltd.), a colloid mill (manufactured by Shinko Pantec Co., Ltd.), a trigonal wet pulverizing mill (manufactured by Mitsui Miike Machinery Co., Ltd.) and CAVITRON (Eurotech, LTD), and batch and/or continuous emulsifying machine such as CLEAR MIX (manufactured by M technique).

Removing Solvent

In the removing of the solvent, the solvent is removed from the dispersed suspension of the toner composition obtained in preparing the dispersed suspension. By this, a dispersion of the colored particles can be obtained. The dispersion of the colored particles is a liquid where the toner composition and, if necessary, additives such as an inorganic dispersant are dispersed.

In the removing of the solvent, the solvent contained in droplets of the dispersed suspension is removed preferably by cooling or heating the dispersed suspension at a temperature within the range of about 0 to about 100° C. Specifically, the method of removing the solvent is preferably the following method (1) or (2).

(1) An air current is blown to the dispersed suspension, thereby forcibly renewing a gaseous phase on the dispersed suspension. In this case, a gas may be blown into the dispersed suspension.

(2) The dispersed suspension is depressurized at a pressure of not less than about 1.33 kPa and less than about 101 kPa (not less than 10 mmHg and less than 760 mmHg). In this case, a gaseous phase on the dispersed suspension may be forcibly renewed by purge of a gas, or a gas may be blown into the suspension.

Other Steps

In this embodiment, the following washing/dehydration, and/or a drying/screening may be carried out if necessary in addition to the steps described above.

In the washing/dehydration, after an aqueous medium is removed from the dispersion of the colored particles obtained by the solvent removing, the colored particles are washed and dehydrated to give a cake of the colored particles. In this washing/dehydration, it is preferable that the dispersion of the colored particles obtained in the solvent removing is treated with acid to dissolve the inorganic dispersant, followed by washing with water and subsequent dehydration. After the acid treatment, alkali treatment may be additionally carried out.

In the drying/screening, the cake of colored particles obtained by the washing/dehydration is dried and screened to give colored particles. In this drying, drying and screening may be carried out by any methods as far as the colored particles do not aggregate or is not smashed.

In this embodiment, the colored particles obtained in the manner described above, which are not subject to any treatment, may be used as a toner for development of an electrostatic image or may be surface-treated with external additives such as a fluidizing agent and an auxiliary agent before use as a toner for development of an electrostatic image.

Examples of the usable external additives include known particles, for example inorganic particles such as surface-hydrophobated silica particles, titanium oxide particles, alumina particles, cerium oxide particles and carbon black, and particles of polymer such as polycarbonate, polymethyl methacrylate, and silicone resin. It is preferable that and at least two kinds of the external additives are used, and that at least one of the external additives has an average primary particle diameter in the range of about 30 nm to about 200 nm. The average primary particle diameter is more preferably in the range of about 30 nm to about 180 nm.

When the particle diameter of the toner is decreased, the non-electrostatic adhesion of the toner to a photoreceptor increases and image defects such as transfer insufficiency are caused, generating transfer unevenness in a color image upon superposition. Transferability can be improved by adding a large-diameter external addictive having an average primary particle diameter of about 30 to about 200 nm.

When the average primary particle diameter of the external additive is less than about 30 nm, the toner is initially excellent in flowability, but the non-electrostatic adhesion between the toner and a photoreceptor cannot be reduced to a required level, thus reducing the efficiency of transfer, generating missing portions in an image, and deteriorating image uniformity in some cases. Due to stress with time in a developing device, the particles are embedded in the surface portion of the toner, thus changing charging property and causing problems such as reduction in toner density at the time of output and fogging in background in some cases. When the average primary particle diameter is greater than about 200 nm, the external additive may be easily removed from the surface of the toner, and flowability of the toner may deteriorate.

<Electrostatic Image Developer>

The toner for development of an electrostatic image according to the invention may be used as a one-component developer as it is or may be used in a two-component developer. When the toner is used in a two-component developer, it is mixed with a carrier to form a two-component developer.

The carrier usable in the two-component developer is not particularly limited, and any known carrier can be used. Examples thereof include magnetic metals such as iron oxide, nickel, and cobalt; magnetic oxides such as ferrite and magnetite; resin-coated carriers each having a resin coating layer on the surface of a core; and magnetic dispersion type carriers. The carrier may also be a resin dispersion carrier in which an electrically conductive material is dispersed in a matrix resin.

Examples of the coating resin or matrix resin usable in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin having organosiloxane bonds and a modified product thereof; fluororesin, polyester, polycarbonate, phenolic resin, and epoxy resin.

Examples of the electrically conductive material include, but are not limited to, metals such as gold, silver, and copper; carbon black; and titanium oxide, zinc oxide, barium sulfate, aluminum borate, potassium titanate, tin oxide, and carbon black.

Examples of the core material of the carrier include magnetic metals, such as iron, nickel, and cobalt; magnetic oxides such as ferrite and magnetite; and a glass bead. The core material is preferably a magnetic substance when the carrier is used in a magnetic brush method. The volume-average particle diameter of the core of the carrier is generally in the range of about 10 to about 500 μm, and preferably in the range of about 30 to about 100 μm.

In order to coat the surface of the core of the carrier with resin, a coating liquid for forming a resin layer in which a coating resin and other optional additives are dissolved in an appropriate solvent can be applied to the surface of the core to form a coating layer. The solvent is not particularly limited, and may be selected as appropriate in consideration of the type of the coating resin used, and/or suitability for coating.

Specific examples of a resin coating method include a dipping method in which the core of a carrier is dipped in a coating liquid; a spray method in which a coating liquid is sprayed onto the surface of the core of a carrier; a fluidized bed method in which a coating liquid is sprayed onto the core of the carrier that is being floated by fluidizing air; and a kneader coater method in which the core of a carrier is mixed with a coating liquid in a kneader coater and the solvent is removed.

The mixing ratio (ratio by mass) of the toner of the invention to the carrier in the two-component developer is preferably in the range of about 1:100 (toner to carrier) to about 30:100, and more preferably in the range of about 3:100 to about 20:100.

<Image Forming Apparatus>

Next, the image forming apparatus using the toner for development of an electrostatic image according to the invention will be explained.

The image forming apparatus of the invention has an image-holding member, a developing unit for developing with a developer as a toner image an electrostatic image formed on the image-holding member, a transfer unit for transferring the toner image formed on the image-holding member onto a recording medium, and a fixing unit for fixing the toner image transferred onto the recording medium, wherein the electrostatic image developer of the invention is used as the developer.

In the image forming apparatus, for example, the part containing the developing unit may be a cartridge structure (process cartridge) attachable to and detachable from the main body of the image forming apparatus, and the process cartridge is preferably one including at least a developer-holding member, and holding the electrostatic image developer of the invention.

Hereinafter, the image forming apparatus of the invention is described in detail by reference to one example, but is not limited thereto. Principal parts shown in the figure are described, and description of other parts is omitted.

FIG. 1 is a drawing showing a full-color image-forming apparatus in a 4-tandem system. The image forming apparatus shown in FIG. 1 is provided with first to fourth image forming units 10Y, 10M, 10C, and 10K in an electrophotographic system outputting an image of each color of yellow (Y), magenta (M), cyan (C) and black (K) based on color-separated image data. These image forming units (hereinafter referred to simply as "units") 10Y, 10M, 10C, and 10K are horizontally arranged with a predetermined space therebetween. The units 10Y, 10M, 10C and 10K may be process cartridges attachable to and detachable from the main body of the image forming apparatus.

Above the respective units 10Y, 10M, 10C and 10K, an intermediate transfer belt 20 is arranged as an intermediate transfer body through the respective units. The intermediate transfer belt 20 is arranged by being wound around a driving roller 22 and a support roller 24 in contact with the inner surface of the intermediate transfer belt 20, the rollers 22 and 24 being arranged to be apart from each other from the left to right, and the intermediate transfer belt 20 runs in the direction of from the first unit 10Y to the fourth unit 10K. The support roller 24 is biased with a spring or the like (not shown) so as to be apart from the driving roller 22, and a predetermined tension is applied to the intermediate transfer belt 20 wound between the two rollers. An intermediate transfer body cleaning unit 30 opposite to the driving roller 22 is provided so that the cleaning unit 30 is brought into contact with the image-holding side of the intermediate transfer belt 20.

4-Color (yellow, magenta, cyan, black) toners held in toner cartridges 8Y, 8M, 8C and 8K can be supplied to developing units 4Y, 4M, 4C and 4K for the respective units 10Y, 10M, 10C and 10K.

The first to fourth units 10Y, 10M, 10C and 10K have a configuration similar to one another, so that only the first unit 10Y forming a yellow image, arranged on the upstream side of the intermediate transfer belt, is described. A description of the second to fourth units 10M, 10C and 10K is omitted by assigning reference marks given magenta (M), cyan (C) and black (K) in place of yellow (Y) given to the equivalent part of the first unit 10Y.

The first unit 10Y has a photoreceptor 1Y acting as an image holding member 1Y. A charging roller 2Y, an exposure unit 3, a development unit 4Y, a primary transfer roller 5Y (primary transfer unit) and a photoreceptor cleaning unit (cleaning unit) 6Y are sequentially provided around the photoreceptor 1Y. The charging roller 2Y electrically charges the surface of the photoreceptor 1Y at a predetermined potential. The exposure unit 3 exposes the charged surface to laser light 3Y based on color-separated image signals to form an electrostatic image. The development unit 4Y develops the electrostatic image by feeding a charged toner to the electrostatic image. The primary transfer roller 5Y transfers the resultant toner image onto the intermediate transfer belt 20. The photoreceptor cleaning unit 6Y removes a toner remaining on the surface of the photoreceptor 1Y after primary transfer.

The primary transfer roller 5Y is arranged in the inside of the intermediate transfer belt 20 and arranged in a position opposite to the photoreceptor 1Y. A bias power source (not shown) for applying primary transfer bias is electrically connected to each of the primary transfer rollers 5Y, 5M, 5C and 5K. Each bias power source can be controlled by controller (not shown) to change the transfer bias applied to each primary transfer roller.

Hereinafter, an operation of forming a yellow image in the first unit 10Y is described. First, the surface of the photoreceptor 1Y is charged at a potential of about −600 V to about −800V with a charging roller 2Y prior to operation.

The photoreceptor 1Y is formed by laminating a photosensitive layer on an electroconductive (volume resistivity at 20° C.: $1\times10^{-6}$ Ωcm or less) substrate. This photosensitive layer is usually highly resistant (with approximately the same resistance as that of general resin), but upon irradiation with laser ray 3Y, changes the specific resistance of the portion irradiated with the laser ray. According to image data for yellow sent from the controller (not shown), the layer ray 3Y is outputted from the exposure device 3 onto the surface of the charged photoreceptor 1Y. The photosensitive layer as the surface portion of the photoreceptor 1Y is irradiated with the laser ray 3Y, whereby an electrostatic image in a yellow print pattern is formed on the surface of the photoreceptor 1Y.

An electrostatic image is an image formed on the surface of the photoreceptor 1Y by charging. That is, this image is a negative latent image that is obtained by causing the electrification charge of the surface of the photoreceptor 1Y to flow due to a reduction in the specific resistance of the irradiated portion of the photosensitive layer, while charge remains on the portion not irradiated with laser ray 3Y.

The electrostatic image thus formed on the photoreceptor 1Y is rotated to a predetermined development position with running of the photoreceptor 1Y. In this development position, the electrostatic image on the photoreceptor 1Y is made visual (developed) with the development unit 4Y.

For example, a yellow toner having a volume-average particle diameter of 7 μm, containing at least a yellow coloring agent, a crystalline resin and a non-crystalline resin, is accommodated in the development unit 4Y. The yellow toner is stirred in the inside of the development unit 4Y and thereby frictionally charged and retained on a developer roll (developer-holding member) and has the same polarity (negative polarity) as that of electrification charge on the photoreceptor 1Y. Then, the surface of the photoreceptor 1Y passes through the development unit 4Y, thereby allowing the yellow toner to adhere electrostatically to the electrically neutralized latent image portion on the surface of the photoreceptor 1Y, and thus developing the latent image with the yellow toner. The photoreceptor 1Y having the resultant yellow toner image formed thereon is subsequently delivered at a predetermined speed, and the toner image developed on the photoreceptor 1Y is sent to a predetermined primary transfer position.

When the yellow toner image on the photoreceptor 1Y reaches the primary transfer position, a predetermined primary transfer bias is applied to the primary transfer roller 5Y, and electrostatic force from the photoreceptor 1Y to the primary transfer roller 5Y acts on the toner image, and the toner image on the photoreceptor 1Y is transferred onto the intermediate transfer belt 20. The transfer bias to be applied has (+) polarity reverse to the polarity (−) of the toner, and for example, the transfer bias in the first unit 10Y is regulated at about +10 μA by the controller (not shown).

On the other hand, the toner remaining on the photoreceptor 1Y is removed and recovered by a cleaning unit 6Y.

The primary transfer bias applied to primary transfer rollers 5M, 5C and 5K after second unit 10M is also controlled in the same manner as in the first unit.

The intermediate transfer belt 20 having the yellow toner image transferred thereon in the first unit 10Y is delivered through the second to fourth units 10M, 10C., and 10K in this order, whereby plural color toner images are transferred to the intermediate transfer belt 20.

The intermediate transfer belt 20 having four color toner images transferred thereon through the first to fourth units reaches a secondary transfer part composed of the intermediate transfer belt 20, the support roller 24 in contact with the inner surface of the intermediate transfer belt 20, and a secondary transfer roller (secondary transfer unit) 26 arranged in the side of the image-holding surface of the intermediate transfer belt 20. On one hand, a recording paper (recording medium) P is fed via a feeding mechanism with predetermined timing into a gap between the secondary transfer roller 26 and the intermediate transfer belt 20 that are contacted with each other with pressure, and a predetermined secondary transfer bias is applied to the support roller 24. The transfer bias to be applied has the same (−) polarity as the polarity (−) of the toner, and electrostatic force from the intermediate transfer belt 20 to the recording paper P acts on the toner image, and the toner image on the intermediate transfer belt 20 is transferred onto the recording paper P. The secondary transfer bias is determined depending on resistance detected by a resistance detector (not shown) for detecting the resistance of the secondary transfer part and is voltage-controlled.

Thereafter, the recording paper P is sent to a fixing unit 28 where the composite toner image is heated, and the componential color toner images are fused and fixed on the recording paper P.

In the case of heat fixation with the fixing unit 28, a releasing oil may be fed to a fixing member in the fixing unit in order to prevent offset. The amount of the releasing oil fed to the fixing member is preferably in the range of up to about $2.0\times10^{-2}$ mg/cm$^2$, more preferably in the range of up to about $8.0\times10^{-3}$ mg/cm$^2$.

The releasing oil is not particularly limited, and typical examples thereof include liquid releasing agents such as dimethyl silicone oil, fluorinated oil, fluorosilicone oil, and modified oils such as amino-modified silicone oil. Among these, modified oils such as amino-modified silicone oil are excellent in coatability on the fixing member and thus preferable from the viewpoint of formation of a uniform releasing agent layer by adsorption onto the surface of the fixing member. In addition, from the viewpoint of formation of a uniform releasing agent layer, fluorinated oil and fluorosilicone oil are also preferable.

A method for supplying the releasing oil to the surface of the roller or belt (the fixing member) for heating and pressure fixing is not particularly limited, and examples thereof include a pad method which uses a pad impregnated with a liquid releasing agent, a web method, a roller method, and a non-contact-type shower method (a spray method). Among them, a web method and a roller method are preferable.

Examples of the recording medium onto which a toner image is transferred include plain paper used in a copier or printer in an electrophotographic system and an OHP sheet.

To further improve the smoothness of the surface of an image after fixation, the surface of the transfer material is also preferably as smooth as possible, and, for example, coated paper obtained by coating plain paper with a resin, and art paper for printing can be preferably used.

The image glossiness (75°) of a monochromatic image of each of cyan, magenta and yellow which monochromatic image has an image are rate of 100% is preferably about 50% or more. In a full-color image, the glossiness of the image is preferably high from the viewpoints of coloration and reproduction of photographic image quality. When a highly glossy paper such as enamel paper is used for high image quality, and the glossiness of the image is significantly lower than the glossiness of the paper, an image seems visually dark on the paper. Thus, the glossiness of the fixed image is preferably higher than the glossiness of the paper. For example, when an enamel paper such as coated paper having a glossiness (75°) of 50% or more is used, the glossiness of an image after fixation is preferably about 50% or more, and more preferably about 60% or more. The glossiness can be measured according to JIS Z 8741, the disclosure of which is incorporated by reference herein.

After conclusion of fixation of the color image, the recording paper P is delivered toward an ejection portion to finish a series of color-image forming operations.

The image forming apparatus illustrated above is structured such that a toner image is transferred via the intermediate transfer belt 20 onto the recording paper P, but may, without limitation to this structure, be structured such that a toner image is transferred directly from the photoreceptor to the recording paper.

<Process Cartridge, and Toner Cartridge>

Figure 2:
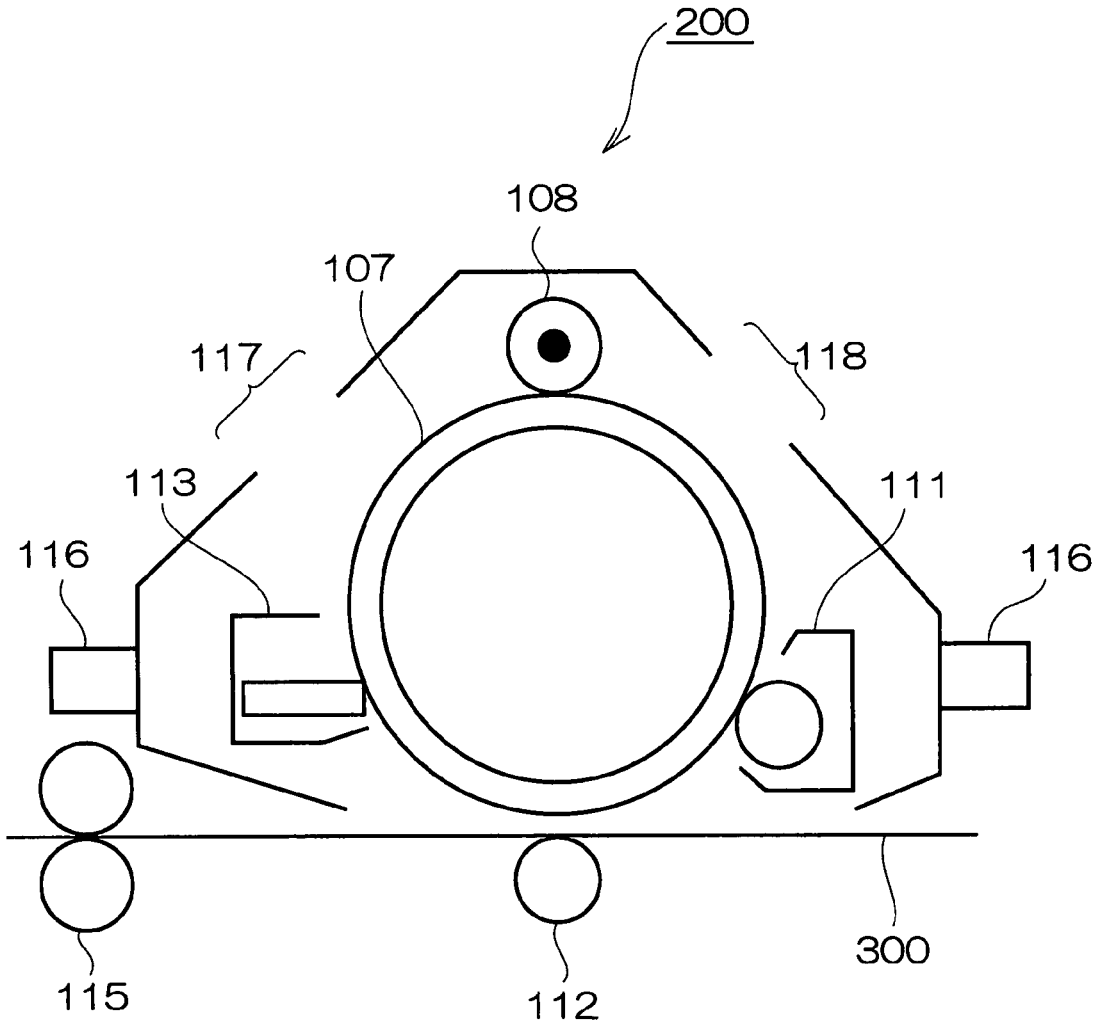
FIG. 2 is a drawing schematically showing one example a process cartridge of the invention.

FIG. 2 is a drawing showing one preferable example of an process cartridge for holding the electrostatic image developer of the invention. The process cartridge 200 includes a charging roller 108, a development unit 111, a photoreceptor cleaning unit 113, an opening 118 for light exposure, and an opening 117 for electrical neutralization and light exposure, which are combined with an attachment rail 116 and integrated with a photoreceptor 107.

Then, the process cartridge 200 is arbitrarily attachable to and detachable from the main body of the image forming apparatus constituted from the transfer unit 112, the fixing unit 115 and other component parts (not shown), and together with the main body of the image forming apparatus, forms the image forming apparatus.

The process cartridge 200 shown in FIG. 2 is provided with the charging unit 108, the development unit 111, the cleaning unit 113, the opening 118 for light exposure, and the opening 117 for electrical neutralization and light exposure, and these units can be arbitrarily combined. The process cartridge of the exemplary embodiment is provided with the photoreceptor 107 and at least one member selected from the group consisting of the charging unit 108, the development unit 111, the cleaning unit 113, the opening 118 for light exposure, and the opening 117 for electrical neutralization and light exposure.

Then, the toner cartridge of the invention is described. The toner cartridge of the invention is a toner cartridge fit detachably to the image forming apparatus and accommodating at least a toner to be fed to a development unit arranged in the image forming apparatus, wherein the toner is the toner of the invention. The toner cartridge of the invention accommodates at least a toner, and, for example, a developer may be accommodated therein depending on the mechanism of the image forming apparatus.

In the image forming apparatus structured so that the toner cartridge can be attached thereto and detached therefrom, the toner cartridge accommodating the toner of the invention can be utilized to maintain storage stability particularly in a small container and to attain low-temperature fixation while maintaining high image quality.

The image forming apparatus shown in FIG. 1 is an image forming apparatus structured so that the toner cartridges 8Y, 8M, 8C and 8K can be attached to the apparatus and detached from the apparatus. The development units 4Y, 4M, 4C and 4K are connected via toner feeding pipes (not shown) to the toner cartridges corresponding to the respective development units (colors). When the toner accommodated in the toner cartridge is reduced, the toner cartridge can be exchanged with another.

EXAMPLES

Hereinafter, the invention will be described in detail with reference to Examples, but it should be understood that the invention is not restricted thereto. The "part" and "%" in the Examples below mean respectively "part by weight" and "% by weight", unless otherwise specified.

<Method of Measuring Various Characteristics>

First, methods of measuring physical properties of the toner and the like used in Examples and Comparative Examples (excluding the previously described methods) are described.

Volume-average particle diameter of resin particles, colored particles of the like The volume-average particle diameter of the resin particles, colored particles or the like are measured with a laser diffraction-type particle size distribution measuring device (LA-700 manufactured by Horiba, Ltd.).

Number average dispersion diameter of crystalline polyester resin

First, for use in embedding of the toner, 7 g of bisphenol A liquid epoxy resin (Asahi Kasei Chemical) and 3 g of a curing agent ZENAMID 250 (Henkel Japan) are mixed, and the resultant mixture is then mixed with 1 g of toner, and the resulting blend is left and solidified to prepare a sample for cutting. Then, this sample for cutting embedded is cut with a cutting device LEICA ultra-microtome (model number: ULTRACUT UCT manufactured by Hitachi High Technology) equipped with a diamond knife (model number: TYPE CRYO manufactured by DIATOME) at −100° C. to give a sample for observation.

Then, the sample for observation is stained by leaving it in a ruthenium tetraoxide (Soekawa Chemical Co., Ltd.) atmosphere in a desiccator. The degree of staining is judged visually on the basis of the degree of staining of a simultaneously left tape. This stained sample is used to observe a section of the toner with a high-resolution field emission scanning electron microscope (S-4800 manufactured by Hitachi High Technologies). At this time, the sample is observed at a 5000-fold magnification.

In the observation under the electron microscope, the crystalline polyester resin occurs as an island-like structure in a sea-like structure of the non-crystalline polyester resin in the inside of the toner, and the particle diameters of 3,000 toner particles are measured as circle-equivalent diameters by an image analyzer (trade name: LUZEX manufactured by NIRECO Corporation), and the average diameter is determined as number-average dispersion diameter of the crystalline polyester resin.

Resin Melting Temperature, and Glass Transition Temperature

The melting temperature (Tm1) of the crystalline polyester resin, the glass transition temperature (Tg) of the non-crystalline polyester resin, and Tm2 and Tm3 of the toner are determined by using a differential scanning calorimeter (DSC3110, thermal analysis system 001, manufactured by Mac Science) under the conditions described previously according to JIS K7121:1987. The peak temperature of an endothermic peak is regarded as the melting temperature, and the temperature at a midpoint in stepwise change in endothermic quantity is regarded as the glass transition temperature.

<Synthesis of Each Resin>

Crystalline Polyester Resin (1)

A three-necked flask dried by heating is charged with 43.4 parts of dimethyl sebacate, 32.8 parts of 1,10-decanediol, 27 parts of dimethyl sulfoxide and 0.03 part of catalyst dibutyltin oxide, and after the air in the container is replaced by a nitrogen gas through depressurization, the mixture is stirred in the inactive atmosphere under mechanical stirring at 180° C. for 4 hours. The dimethyl sulfoxide is distilled away under reduced pressure, and thereafter, the mixture is gradually heated to 220° C. under reduced pressure and stirred for 1.5 hours. When the mixture becomes viscous, it is air-cooled to terminate the reaction, whereby 65 parts of aliphatic crystalline polyester resin (1) are synthesized.

By measurement of (polystyrene-equivalent) molecular weight by gel permeation chromatography (GPC), the weight-average molecular weight (Mw) of the resulting crystalline polyester resin (1) is 3,400. In measurement with a differential scanning calorimeter (DSC), the crystalline polyester resin (1) shows a clear peak, and the melting temperature Tm1 is 76° C. The solubility parameter SPA (1) of the crystalline polyester resin (1) as determined by the method of Fedors et al. is 9.11.

Crystalline Polyester Resin (2)

A crystalline polyester resin (2) is synthesized in the same manner as in synthesis of the crystalline polyester resin (1) except that 22.3 parts of 1,6-hexanediol is used in place of 32.8 pars of 1,10-decanediol. The weight-average molecular weight (Mw) of the resulting crystalline polyester resin (2), as determined by GPC, is 3,200. In measurement with DSC, the crystalline polyester resin (2) shows a clear peak, and the melting temperature is 68° C. The solubility parameter SPA (2) of the crystalline polyester resin (2) is 9.32.

Crystalline Polyester Resin (3)

A two-necked flask dried by heating is charged with 200 parts of dimethyl terephthalate, 188.8 parts of 1,10-decanediol, 11.3 parts of dimethyl 5-tert-butylisophthalate, 200 parts of dimethyl sulfoxide, and 0.3 part of catalyst dibutyltin oxide, and after the air in the container is replaced by a nitrogen gas through depressurization, the mixture is stirred in the inactive atmosphere under mechanical stirring at 180° C. for 5 hours. Thereafter, the mixture is gradually heated to 230° C. under reduced pressure and stirred for 1 hour. When the mixture becomes viscous, it is air-cooled, and the reaction is terminated, whereby 340 parts of crystalline polyester resin (3) are synthesized.

The weight-average molecular weight (Mw) of the resulting crystalline polyester resin (3), as determined by GPC, is 2,800. In measurement with DSC, the crystalline polyester resin (3) shows a clear peak, and the melting temperature is 110° C. The solubility parameter SPA (3) of the crystalline polyester resin (3) is 9.48.

Non-crystalline Polyester Resin (1)

A two-necked flask dried by heating is charged with 488 parts of polyoxypropylene (2,2)-2,2-bis(4-hydroxyphenyl) propane, ethylene glycol and cyclohexane diol (constituent molar ratio: 80/10/10) as the diol component, 356 parts of terephthalic acid, isophthalic acid and n-dodecenylsuccinic acid (constituent molar ratio: 80/10/10) as the dicarboxylic acid component, and 0.6 part of catalyst dibutyltin oxide. Nitrogen gas is introduced so that the mixture is kept under the inactive atmosphere. The mixture is then heated, subjected to polycondensation polymerization reaction at a temperature within the range of 150 to 230° C. for 12 hours, and depressurized gradually at a temperature within the range of 210 to 250° C. to synthesize a non-crystalline polyester resin (1).

The weight-average molecular weight (Mw) of the resulting non-crystalline polyester resin (1) is 12,300. In DSC measurement in accordance with the above-mentioned measurement of melting temperature, no clear peak is shown, and a stepwise change in endothermic quantity is observed. The glass transition temperature (Tg) that is a midpoint of the stepwise change in endothermic quantity is 64° C. The solubility parameter SPB (1) of the non-crystalline polyester resin (1) is 9.73.

Non-crystalline Polyester Resin (2)

A non-crystalline polyester resin (2) is synthesized in the same manner as in synthesis of the non-crystalline polyester resin (1) except that a two-necked flask dried by heating is charged with 498 parts of polyoxypropylene (2,0)-2,2-bis(4-hydroxyphenyl) propane and ethylene glycol (constituent molar ratio: 90/10) as the diol component, and 332 parts of terephthalic acid and isophthalic acid (constituent molar ratio: 80/20) as the dicarboxylic acid component.

The weight-average molecular weight (Mw) of the resulting non-crystalline polyester resin (2) is 13,200. In DSC measurement in accordance with the above-mentioned measurement of melting temperature, no clear peak is shown, and a stepwise change in endothermic quantity is observed. The glass transition temperature (Tg) that is a midpoint of the stepwise change in endothermic quantity is 66° C. The solubility parameter SPB (2) of the non-crystalline polyester resin (2) is 10.36.

<Preparation of Each Dispersion>

Crystalline Polyester Resin Dispersion 30 parts of the crystalline polyester resin (1) and 270 parts of ethyl acetate are wet-dried in a state cooled to 3° C. with a DCP mill to prepare a crystalline polyester resin dispersion (1) (solid content: 10%). The volume-average particle diameter of the dispersed particles is 0.54 μm.

A crystalline polyester resin dispersion (2) is prepared in the same manner as the crystalline polyester resin dispersion (1) except that the temperature is ordinary temperature, and the solid content is 20%. The volume-average particle diameter of the dispersed particles is 1.52 μm.

A crystalline polyester resin dispersion (3) (volume-average particle diameter: 0.52 μm) is obtained in the same manner as the crystalline polyester resin dispersion (1) except that the crystalline polyester resin (2) is used in place of the crystalline polyester resin (1). In addition, a crystalline polyester resin dispersion (4) (volume-average particle diameter: 0.62 μm) is obtained in the same manner as the crystalline polyester resin dispersion (1) except that the crystalline polyester resin (3) is used in place of the crystalline polyester resin (1).

Pigment Dispersion 75 parts of cyan pigment (C.I. Pigment Blue 15:3 manufactured by Dainichiseika Color & Chemicals Mfg. Co., Ltd.), 412.4 parts of ethyl acetate, and 12.6 parts of solvent-freed DISPARON DA-703-50 (polyester acid amide amine salt manufactured by Kusumoto Chemicals, Ltd.) are stirred with a DCP mill (manufactured by Nippon Eirich Co., Ltd.) to prepare a pigment dispersion.

Releasing Agent Dispersion 30 parts of paraffin wax (melting temperature: 75° C.) and 270 parts of ethyl acetate are wet-milled in a stage cooled to 5° C. in a DCP mill to prepare a releasing agent dispersion. The volume-average particle diameter of the dispersed particles is 0.48 μm.

<Preparation of Carrier>

Ferrite particles (volume average particle diameter: 35 μm): 100 parts

Toluene: 14 parts

Perfluoroacrylate copolymer (critical surface tension of 24 dyn/cm, weight-average molecular weight of 68000): 1.6 parts Carbon black (trade name: VXC-72, volume resistivity: 100 Ωcm or less, manufactured by Cabot Corporation): 0.12 parts Crosslinked melamine resin particles (average particle diameter: 0.3 μm, insoluble in toluene): 0.3 parts First, carbon black is diluted with toluene and added to the perfluoroacrylate copolymer and the resultant mixture is then stirred with a sand mill. Then, the above components except for ferrite particles are stirred for 10 minutes with a stirrer to prepare a coating layer-forming solution. Then, this coating layer-forming solution and ferrite particles are introduced into a vacuum degassing kneader and stirred at a temperature of 60° C. for 30 minutes and then depressurized to distil away the toluene, whereby a carrier having a resin coating layer is obtained.

EXAMPLE 1

Production of Toner

-Preparation of Liquid Mixture- 65.5 parts of the non-crystalline polyester resin (1), 30 parts of the pigment dispersion, 100 parts of the releasing agent dispersion, and 200 parts of the crystalline polyester resin (1) dispersion are stirred for 30 minutes with a mechanical stirrer until the mixture becomes uniform. Thus, a liquid mixture (1) is obtained.

-Preparation of Dispersed Suspension, and Removal of Solvent- 124 parts of a calcium carbonate dispersion having 40 parts of calcium carbonate dispersed in 60 parts of water, 99 parts of 2% aqueous solution of CELLOGEN BS-H (Dai-ichi Kogyo Seiyaku Co., Ltd.), and 157 parts of water are mixed and stirred for 3 minutes with a homogenizer (trade name: Ultratarax, manufactured by IKA) to give a liquid dispersion.

345 parts of the liquid mixture (1) are mixed with 250 parts by weight of the liquid dispersion and stirred at 10,000 rpm for 1 minute with a homogenizer (trade name: Ultratarax, manufactured by IKA) to give a dispersed suspension. During stirring, the mixture is externally cooled such that the temperature of the liquid is regulated to be 15° C.

Then, the resulting dispersed suspension is stirred, while a gaseous phase on the suspension is forcibly renewed with a locally discharging device at 40° C. This state is kept for 24 hours, thus removing the solvent. Thus, a colored particle dispersion (1) is obtained.

-Washing/dehydration, and Drying/screening- 300 parts of the resulting colored particle dispersion (1) is screened with a 20-μm mesh. Thereafter, 40 parts of 10 N hydrochloric acid is added to the resulting dispersion to remove calcium carbonate, and then the sample is washed 4 times with deionized water by filtration under suction to give wet powder. Thereafter, the resulting wet powder is dried with a vacuum drier and screened through a 45-μm mesh to give colored particles (1). The particle size distribution of the resulting colored particles (1) is measured with MULTISIZER II (aperture diameter: 50 μm, manufactured by Beckman Coulter, Inc.), and the volume-average particle diameter is 6.1 μm.

Silica particles having a primary particle diameter of 40 nm and having a surface made hydrophobic (hydrophobic silica RX50 manufactured by Aerosil Co.), and metatitanic acid compound particles having a primary particle average diameter of 20 nm that are a reaction product obtained by treating 100 parts of metatitanic acid with 40 parts of isobutyltrimethoxysilane and 10 parts of trifluoropropyltrimethoxysilane are added respectively to the colored particles (1) as external additives such that their content in the toner becomes 1.0%. Then, the mixture is stirred for 5 minutes in a HENSCHEL mixer. Further, the product is further subjected to an ultrasonic vibrating screen (manufactured by Dalton Co., Ltd.) to give a toner (1).

Toner Characteristics

-Number-average Dispersion Diameter of Crystalline Polyester Resin-

The number-average dispersion particle diameter of the crystalline polyester resin in the resulting toner (1), as determined by observing a section of the toner under a transmission electron microscope by the method described above, is 0.57 μm.

-Thermal Analysis of Toner (Tm2, Tm3)-

The toner (1) is subjected to DSC measurement under the conditions described above, and Tm2 determined from a clear endothermic peak in a DSC curve in a first step of raising temperature is 75° C., and Tm3 determined from a clear endothermic peak in a DSC curve in a second step of raising temperature is 68° C.

-Powder Aggregating Property (Toner Blocking Resistance)-

As a sample, the toner (1) left for 24 hours in an atmosphere of 55° C./50% RH is used.

Using a powder tester (manufactured by Hosokawa Micron Corporation), screens having openings of 53 μm, 45 μm and 38 μm are arranged downward in series, and 2 g of the accurately weighed sample is introduced onto the 53-μm screen and then vibrated with a vibration amplitude of 1 mm for 90 seconds, and the mass of the toner on each screen after vibration is measured, and the mass of the toner on the 53-μm screens is multiplied by 0.5, the mass of the toner on the 45-μm screens is multiplied by 0.3 and the mass of the toner on the 38-μm screens is multiplied by 0.1 to determine products, and the percentage of the total sum of these products (%) relative to the original weight (2 g) of the sample is used as an indicator of powder aggregating property. This measurement is carried out in an atmosphere of 25° C./50% RH. When the indicator of powder aggregating property after vibration is 40 or less in this evaluation, the sample can be used usually without practical problems, and the indicator of power aggregation is more preferably 30 or less.

Evaluation in Real Machine 36 parts of the resulting toner (1) and 414 parts of the carrier are introduced into a 2-L V-blender and stirred for 20 minutes and then screened through a 212-μm mesh to prepare a developer (1).

A developing device in DOCUPRINT C2220 (manufactured by Fuji Xerox Co., Ltd.) is charged with The resulting developer (1) and the developer (1) is evaluated as follows.

-Evaluation of Charging Property-

DOCUPRINT C2220 is left for 24 hours in a 28° C./85% atmosphere (in a high temperature/high humidity atmosphere) and then 10 sheets of A3 size without development are outputted. That is, the developer in the developing unit is stirred by actuating the apparatus for only 10 sheets of A3 size without development. Thereafter, the developer is collected from a development sleeve, and the charging amount of the toner in the developer is measured with a blow-off charging measuring instrument (TB-200 manufactured by Toshiba Chemical Corporation). Test result is shown in Table 1.

-Fixability-

The fixing unit is removed from DOCUPRINT C2220 (manufactured by Fuji Xerox Co., Ltd.) charged with the developer (1) to obtain unfixed images. Each image is a 40 mm×50 mm solid image with 1.5 mg/cm$^2$ of toner on J paper (manufactured by Fuji Xerox Official Supply) serving as a recording paper.

While DOCUPRINT C2220 modified to make the fixing temperature variable is used to increase the fixing temperature from 100° C. to 200° C. in increments of +5° C., the fixability of each image is evaluated. In evaluation, a good fixed image without image defects attributable to insufficient release is bent for 5 seconds with a loading of 1 kg, and the width of an image defect at that portion is indicated in mm unit, and the temperature at which the width of the defect becomes 1 mm or less is defined as minimum fixing temperature. In this evaluation, it is assumed that there is low-temperature fixability when the fixing temperature is 120° C. or less. The result is shown in Table 1.

-Image Gloss-

The glossiness of a sample image fixed at a temperature higher by 20° C. than the minimum fixing temperature determined in the above evaluation of fixability is evaluated. This measurement is carried out at an incidence angle of 75° with Gloss Meter GM-26D (manufactured by Murakami Color Research Laboratory) according to JIS Z 8741, the disclosure of which is incorporated by reference. The result is shown in Table 1.

-Strength of Fixed Image-

An unfixed image with 1.5 mg/cm$^2$ of a toner on a recording paper "MIRROR COAT PLATINUM" (manufactured by Fuji Xerox Office Supply) is collected and fixed at a temperature higher by 20° C. than the minimum fixing temperature. The resulting fixed image is examined in a scratch test by scanning it in a distance of 30 mm or more with respect to a needle having a top diameter of 0.2 mm under a loading of 100 g. The scratching is confirmed with the naked eye and evaluated in grades G2 to G5. When the scratching is G3 or more, there is no practical problem.

The results are shown collectively in Table 1.

EXAMPLE 2

A toner (2) is obtained in the same manner as in Example 1 except that the crystalline polyester resin dispersion (3) is used in place of the crystalline polyester resin dispersion (1) in production of the toner in Example 1. The volume-average particle diameter of the toner (2) is 6.5 μm.

A developer is prepared in the same manner as in Example 1 except for use of the resulting toner (2) and is used in evaluation of toner characteristics and in evaluation in a real machine. The results are shown in Table 1.

EXAMPLE 3

A toner (3) is obtained in the same manner as in Example 2 except that the amount of the non-crystalline polyester resin (1) is changed from 65.5 parts in production of the toner in Example 2 to 75.5 parts, and the amount of the crystalline polyester resin dispersion (3) is changed from 200 parts to 100 parts. The volume-average particle diameter of the toner (3) is 6.5 μm.

A developer is prepared in the same manner as in Example 1 except for use of the resulting toner (3) and is used in evaluation of toner characteristics and in evaluation in a real machine. The results are shown in Table 1.

EXAMPLE 4

A toner (4) is obtained in the same manner as in Example 1 except that the amount of the crystalline polyester resin (1) is changed from 200 parts in production of the toner in Example 1 to 420 parts, and the amount of the non-crystalline polyester resin is changed into 43.5 parts. The volume-average particle diameter of the toner (4) is 6.7 μm.

A developer is prepared in the same manner as in Example 1 except for use of the resulting toner (4) and is used in evaluation of toner characteristics and in evaluation in a real machine. The results are shown in Table 1.

EXAMPLE 5

A toner (5) is obtained in the same manner as in Example 1 except that 100 parts of the crystalline polyester resin dispersion (2) are used in place of 200 parts of the crystalline polyester resin dispersion (1) in production of the toner in Example 1. The volume-average particle diameter of the toner (5) is 7.0 μm.

A developer is prepared in the same manner as in Example 1 except for use of the resulting toner (5) and is used in evaluation of toner characteristics and in evaluation in a real machine. The results are shown in Table 1.

Comparative Example 1

67.5 parts of the non-crystalline polyester resin (1), 20 parts of the crystalline polyester resin (2), 5 parts of cyan pigment (C.I. Pigment Blue 15:3 manufactured by Dainichiseika Color & Chemicals Mfg. Co., Ltd.) and 8 parts of paraffin wax (melting temperature: 75° C.) are mixed with one another in a HENSCHEL mixer, and the mixture is kneaded in an extruder, milled with a jet mill, and classified with an air classifier to give a toner (6). The volume-average particle diameter of the toner (6) is 7.0 μm.

A developer is prepared in the same manner as in Example 1 except for use of the resulting toner (6) and is used in evaluation of toner characteristics and evaluation in a real machine. The results are shown in Table 1 (in the table, polyester is abbreviated as "PE").

Comparative Example 2

A toner (7) is obtained in the same manner as in Example 1 except that the non-crystalline polyester resin (2) is used in place of the non-crystalline polyester resin (1) in production of the toner in Example 1. The volume-average particle diameter of the toner (7) is 5.8 μm.

A developer is prepared in the same manner as in Example 1 except for use of the resulting toner (7) and is used in evaluation of toner characteristics and evaluation in a real machine. The results are shown in Table 1.

Comparative Example 3

A toner (8) is obtained in the same manner as in Example 1 except that the crystalline polyester resin dispersion (3) is used in place of the crystalline polyester resin dispersion (1) in production of the toner in Example 1. The volume-average particle diameter of the toner (8) is 6.2 μm.

A developer is prepared in the same manner as in Example 1 except for use of the resulting toner (8) and is used in evaluation of toner characteristics and evaluation in a real machine. The results are shown in Table 1.

Comparative Example 4

A toner (9) is obtained in the same manner as in Example 1 except that the crystalline polyester resin dispersion (1) in production of the toner in Example 1 is not used, and the amount of the non-crystalline polyester resin is changed from 65.5 parts to 85.5 parts. The volume-average particle diameter of the toner (9) is 6.1 μm.

A developer is prepared in the same manner as in Example 1 except for use of the resulting toner (9) and is used in evaluation of toner characteristics and in evaluation in a real machine. The results are shown in Table 1.

TABLE 1

| | | Example 1 | Example 2 | Example 3 | Example 4 | Example 5 |
|---|---|---|---|---|---|---|
| Non-crystalline polyester resin | Resin No. | (1) | (1) | (1) | (1) | (1) |
| | SPB value | 9.73 | 9.73 | 9.73 | 9.73 | 9.73 |
| | Content (wt %) | 65.5 | 65.5 | 75.5 | 43.5 | 65.5 |
| Crystalline polyester resin | Dispersion No. | (1) | (3) | (3) | (1) | (2) |
| | SPA value | 9.11 | 9.32 | 9.32 | 9.11 | 9.11 |
| | Melting temperature Tm1 (° C.) | 76 | 68 | 68 | 76 | 76 |
| | Content (wt %) | 20 | 20 | 10 | 42 | 20 |
| Cyan pigment (wt %) | | 4.5 | 4.5 | 4.5 | 4.5 | 4.5 |
| Releasing agent (wt %) | | 10 | 10 | 10 | 10 | 10 |
| Toner preparation method | | Dissolution suspension | Dissolution suspension | Dissolution suspension | Dissolution suspension | Dissolution suspension |
| Toner characteristics | Volume-average particle diameter (μm) | 6.1 | 6.5 | 6.3 | 6.7 | 7.0 |
| | Tm2 (° C.) | 75 | 67 | 67 | 74 | 74 |
| | Tm3 (° C.) | 68 | 59 | 56 | 69 | 68 |
| | Crystalline polyester resin dispersion diameter (μm) | 0.57 | 0.46 | 0.48 | 0.66 | 1.63 |
| | Powder aggregating property indicator | 8.4 | 7.3 | 7.1 | 25.8 | 24.2 |
| Evaluation in real machine | Charging amount (μC/g) | −37 | −34 | −40 | −32 | −30 |
| | Minimum fixing temperature (° C.) | 115 | 110 | 115 | 110 | 120 |
| | Image glossiness | 62 | 71 | 50 | 88 | 60 |
| | Fixed image strength | G4 | G4.5 | G4.5 | G3 | G4 |

TABLE 1-continued

| | | Comparative Example 1 | Comparative Example 2 | Comparative Example 3 | Comparative Example 4 |
|---|---|---|---|---|---|
| Non-crystalline polyester resin | Resin No. | (1) | (2) | (1) | (1) |
| | SPB value | 9.73 | 10.36 | 9.73 | 9.73 |
| | Content (wt %) | 67.5 | 65.5 | 65.5 | 85.5 |
| Crystalline polyester resin | Dispersion No. | (Crystalline PE (2)) | (1) | (3) | — |
| | SPA value | 9.32 | 9.11 | 9.48 | — |
| | Melting temperature Tm1 (° C.) | 68 | 76 | 110 | — |
| | Content (wt %) | 20 | 20 | 20 | — |
| Cyan pigment (wt %) | | 4.5 | 4.5 | 4.5 | 4.5 |
| Releasing agent (wt %) | | 8 | 10 | 10 | 10 |
| Toner preparation method | | Kneading milling | Dissolution suspension | Dissolution suspension | Dissolution suspension |
| Toner characteristics | Volume-average particle diameter (μm) | 7.0 | 5.8 | 6.2 | 6.1 |
| | Tm2 (° C.) | 59 | 76 | 108 | — |
| | Tm3 (° C.) | 56 | 73 | 90 | — |
| | Crystalline polyester resin dispersion diameter (μm) | Not observed | 0.56 | 0.67 | — |
| | Powder aggregating property indicator | 97.5 | 5.8 | 7.9 | 9.2 |
| Evaluation in real machine | Charging amount (μC/g) | −16 | −30 | −34 | −40 |
| | Minimum fixing temperature (° C.) | 105 | 130 | 135 | 140 |
| | Image glossiness | 74 | 28 | 68 | 22 |
| | Fixed image strength | G4.5 | G2 | G4.5 | G5 |

From the results shown in Table 1, it can be seen that in Examples, Tm1 and Tm2 satisfy the relationship (1) and thus the crystalline polyester resin is dispersed in a non-compatible state in the inside of the toner and the thermal storage stability is good. It is found that, because Tm1 and Tm3 satisfy the relationship (2), the crystalline polyester resin after melting comes to be in a compatible state, and excellent low-temperature fixability and high glossiness can be obtained, and the strength of a fixed image is sufficient. In Example 4, the amount of the crystalline resin is large, so the powder aggregating property, the strength of a fixed image and the charging amount slightly degrade. In Example 5, the particle diameter of the crystalline resin dispersion is as large as 15 μm, the powder aggregating property and the charging amount slightly degrade.

In Comparative Example 1 where a tone prepared by kneading milling is used, the crystalline polyester resin is present in a compatible state in the toner, and the thermal storage stability and charging property degrade. In Comparative Example 2, the crystalline polyester resin even upon melting is not compatible with the non-crystalline polyester resin, thus resulting in failure to attain sufficient low-temperature fixability and high glossiness. In Comparative Example 3, the melting temperature of the crystalline resin is too high and sufficient low-temperature fixability cannot be obtained. In Comparative Example 4, the toner contains only the non-crystalline polyester resin as a binder resin and is not sufficient from the viewpoint of low-temperature fixability and image glossiness.

What is claimed is:

1. A toner for development of an electrostatic image, the toner comprising colored particles comprising:

a crystalline polyester resin having a melting temperature Tm1 (° C.) of approximately 50 to approximately 100° C.;

a non-crystalline polyester resin; and a coloring agent, wherein the temperature Tm2 (° C.) of an endothermic peak derived from the crystalline polyester resin in a first process of raising temperature and the temperature Tm3 (° C.) of an endothermic peak derived from the crystalline polyester resin in a second process of raising temperature, in differential scanning calorimetry based on JIS K7121: 1987, satisfying the following relationships (1) and (2):

$$0 \leqq (Tm1 - Tm2) < 2 \quad (1)$$

$$4 < (Tm1 - Tm3) \leqq 15 \quad (2),$$

the crystalline polyester resin comprises an acid-derived constituent component derived from a linear dicarboxylic acid and an alcohol-derived constituent component derived from a linear aliphatic diol having 7 to 20 carbon atoms, and the linear dicarboxylic acid is selected from the group consisting of adipic acid, sebacic acid, 1,10-decanedicarboxylic acid, lower alkyl esters thereof, and anhydrides thereof.

2. The toner of claim 1, wherein the content of the crystalline polyester resin in the colored particles is approximately 3 to approximately 40 wt %.

3. The toner of claim 1, wherein the content, among all acid-derived constituent components, of acid-derived constituent components (a constituent component derived from a dicarboxylic acid having a double bond and a constituent component derived from a dicarboxylic acid having a sulfonic acid group) other than an aliphatic dicarboxylic acid-derived constituent component and an aromatic dicarboxylic acid-derived constituent component in the crystalline polyester resin is approximately 1 to approximately 20 constituent-mol %.

4. The toner of claim 1, wherein the content of the aliphatic diol-derived constituent component among alcohol constituent components of the crystalline polyester resin is approximately 90 constituent-mol % or higher.

5. The toner of claim 1, wherein the molecular weight (weight-average molecular weight Mw) of the crystalline polyester resin is approximately 2,000 to approximately 12,000.

6. The toner of claim 1, wherein the acid value of the crystalline polyester resin is approximately 2 to approximately 30 mg KOH/g.

7. The toner of claim 1, wherein the weight-average molecular weight of the non-crystalline polyester resin is approximately 5,000 to approximately 50,000.

8. The toner of claim 1, wherein the glass transition temperature (Tg) of the non-crystalline polyester resin is approximately 40 to approximately 80° C.

9. The toner of claim 1, wherein the toner further comprises a releasing agent in an amount of approximately 0.5 to approximately 50 wt % based on the whole amount of the toner.

10. The toner of claim 1, wherein the crystalline polyester resin is present in a dispersed state in the colored particles, and the number-average dispersion diameter of the crystalline polyester resin in the colored particles is in the range of approximately 0.05 to approximately 1.0 μm.

11. An electrostatic image developer comprising the toner for development of an electrostatic image of claim 1.

12. The developer of claim 11, further comprising a carrier including an electroconductive particle-containing coating resin.

13. A toner cartridge comprising at least a toner stored therein, the toner being the toner for development of an electrostatic image of claim 1.

14. A process cartridge comprising at least a developer-holding member and accommodating the electrostatic image developer of claim 11.

15. An image forming apparatus comprising an image-holding member, a developing unit for developing with a developer as a toner image an electrostatic image formed on the image-holding member, a transfer unit for transferring the toner image formed on the image-holding member onto a recording member, and a fixing unit for fixing the toner image transferred onto the recording member, the developer being the electrostatic image developer of claim 11.

16. A method of producing the toner of claim 1, which comprises respectively dissolving or dispersing at least a coloring agent, a non-crystalline polyester resin and a crystalline polyester resin in a solvent to prepare a liquid mixture of a toner composition, dispersing and suspending the liquid mixture of the toner composition in an aqueous solvent to prepare a dispersed suspension of the toner composition, and removing the solvent from the dispersed suspension of the toner composition.

17. The toner of claim 1, wherein the toner is produced by a dissolution suspension method comprising:

dissolving or dispersing at least the crystalline polyester resin, the non-crystalline polyester resin, and the coloring agent in a solvent to prepare a liquid mixture of a toner composition;

dispersing and suspending the liquid mixture of a toner composition in an aqueous solvent to prepare a dispersed suspension of the toner composition; and removing the solvent from the dispersed suspension of the toner composition.

18. The toner of claim 1, wherein the linear aliphatic diol having 7 to 20 carbon atoms is selected from the group consisting of 1,8-octanediol, 1,9-nonanediol, and 1,10-decanediol.

19. The toner of claim 1, wherein the crystalline polyester resin is obtained by polymerizing sebacic acid with decanediol, and the non-crystalline polyester resin is obtained by polymerizing alkenylsuccinic acid with an alkylene glycol adduct of bisphenol.

* * * * *